US010947745B2

(12) United States Patent
Mizelle

(10) Patent No.: US 10,947,745 B2
(45) Date of Patent: Mar. 16, 2021

(54) PRY BAR FOR CONSTRUCTION APPLICATIONS AND METHODS OF USING THE SAME

(71) Applicant: R. Derek Mizelle, Ayden, NC (US)

(72) Inventor: R. Derek Mizelle, Ayden, NC (US)

(73) Assignee: R. Derek Mizelle, Ayden, NC (US)

( * ) Notice: Subject to any disclaimer, the term of this patent is extended or adjusted under 35 U.S.C. 154(b) by 0 days.

(21) Appl. No.: 16/373,270

(22) Filed: Apr. 2, 2019

(65) Prior Publication Data

US 2020/0102758 A1 Apr. 2, 2020

Related U.S. Application Data

(63) Continuation of application No. 29/665,315, filed on Oct. 2, 2018, now Pat. No. Des. 886,562.

(51) Int. Cl.
*E04F 21/22* (2006.01)
*B66F 15/00* (2006.01)

(52) U.S. Cl.
CPC ..... *E04F 21/22* (2013.01); *B66F 15/00* (2013.01)

(58) Field of Classification Search
CPC ..... E04F 21/22; E04F 21/1855; B25B 5/08; B25B 5/082; B25B 5/085; B25B 5/087; B25B 27/00; B66F 15/00; B27H 1/00; E04G 2023/085
USPC ..... 52/745.05; 254/11–17
See application file for complete search history.

(56) References Cited

U.S. PATENT DOCUMENTS 1,552,912 A * 9/1925 Colt ..... E04G 17/07 254/104
2,676,784 A * 4/1954 Howard ..... E04F 21/22 254/17
2,718,374 A * 9/1955 Kellenbarger ..... E04F 21/1855 254/17
2,956,777 A * 10/1960 Ames ..... E04F 21/22 254/17
D270,895 S * 10/1983 Holloway ..... B66F 15/00 D8/89
4,599,779 A 7/1986 Thibault
D327,206 S * 6/1992 Johnson ..... B66F 15/00 D8/14
5,165,659 A * 11/1992 L'Heureux ..... A62B 3/005 254/131
5,248,127 A * 9/1993 Young ..... E04F 21/22 254/15

(Continued)

*Primary Examiner* — Theodore V Adamos
(74) *Attorney, Agent, or Firm* — Stanek Lemon Crouse & Meeks, PA

(57) ABSTRACT

A pry bar for construction applications and methods of using same is disclosed. The presently disclosed pry bar includes a main pry bar member, a handle, and a pry bar head. The pry bar head further includes a top plate, a faceplate that includes two prongs, a tapered slot between the two prongs, and optionally a pivot edge at the top of the tapered slot, and various support members. A method of using the pry bar is provided that includes the steps of positioning a board to be installed and thereby revealing a gap between the board and a previously installed board, positioning the pry bar head with respect to a floor joist and also with respect to the board to be installed and manipulating the handle of the pry bar until the gap is closed, fastening the board in place.

15 Claims, 27 Drawing Sheets

(56) References Cited

U.S. PATENT DOCUMENTS 5,478,050 A * 12/1995 Ott ..... E04F 21/22 254/17
5,826,858 A * 10/1998 Gordon ..... E04F 21/22 254/17
D417,600 S * 12/1999 Heatwole ..... B25F 1/00 D8/88
6,113,074 A 9/2000 Foley
D450,992 S * 11/2001 Abshire ..... B25B 33/00 D8/14
6,616,132 B1 * 9/2003 Ellison ..... E04F 21/22 269/15
D532,273 S * 11/2006 Yoson ..... D8/88
D569,211 S * 5/2008 Peddie ..... D8/88
8,091,865 B2 1/2012 Eric
D666,469 S * 9/2012 Melanson ..... E04F 21/22 D8/89
D764,244 S * 8/2016 Brock ..... B25B 33/00 D8/14
D770,249 S 11/2016 Mathieu
D772,036 S * 11/2016 Frassetto ..... E04H 12/2215 D8/88
9,821,175 B2 11/2017 Dapkins, Jr. et al.
2002/0134971 A1 * 9/2002 Christensen ..... B66F 15/00 254/25
2005/0212314 A1 * 9/2005 Roderick ..... B25B 27/00 294/211
2006/0137291 A1 * 6/2006 Jensen ..... B25B 33/00 52/749.1
2007/0125991 A1 * 6/2007 Mrugalski, Jr. ..... B25F 1/00 254/17
2010/0186344 A1 * 7/2010 Jones ..... E04F 21/22 52/749.1
2012/0042915 A1 * 2/2012 Dorr ..... E04H 12/2215 135/16
2013/0037066 A1 * 2/2013 Dorr ..... E04H 12/2215 135/16
2016/0039111 A1 * 2/2016 Pelc ..... B25B 5/08 144/270
2018/0370782 A1 * 12/2018 Plunkett ..... B66F 15/00

* cited by examiner

PRY BAR FOR CONSTRUCTION APPLICATIONS AND METHODS OF USING THE SAME

RELATED APPLICATION DATA

The present application claims priority to U.S. patent application Ser. No. 29/665,315, filed Oct. 2, 2018, the contents of which are incorporated herein by reference in its entirety.

TECHNICAL FIELD

The presently disclosed subject matter relates generally to construction aids and more particularly to a pry bar for construction applications and methods of using the same.

BACKGROUND

In wood construction it is not unusual for certain pieces of lumber or boards to be slightly bowed or warped regardless of the quality of the material. Consequently, when installing a bowed or warped piece of lumber, builders may have to apply a certain amount of force to overcome the bowing or warping in order to properly position, align, and/or fasten the piece in place. Such a scenario may require at least two workers, one worker to apply force and hold the piece in place while another worker fastens the piece (e.g., using nails or screws). A solo worker may have particular difficulty in installing a bowed or warped piece of lumber because he/she must be able to both hold a force against the piece of lumber while also nailing or screwing the piece in place.

SUMMARY

Embodiments of the present invention provide a construction tool including a bar member, a handle; and a faceplate including two prongs having a tapered slot therebetween.

Embodiments of the present invention also provide a method of holding a piece of lumber in place while fastening the same. In some embodiments, the method includes using a construction tool including a bar member, a handle and a faceplate including two prongs having a tapered slot therebetween.

BRIEF DESCRIPTION OF THE DRAWINGS

Figure 1:
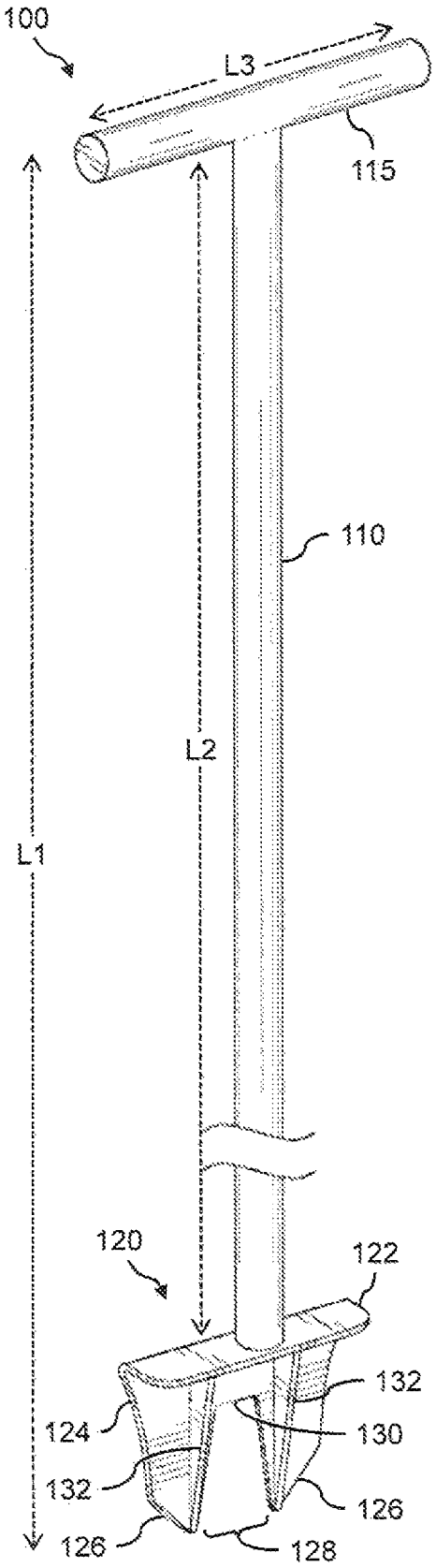
Figure 7:
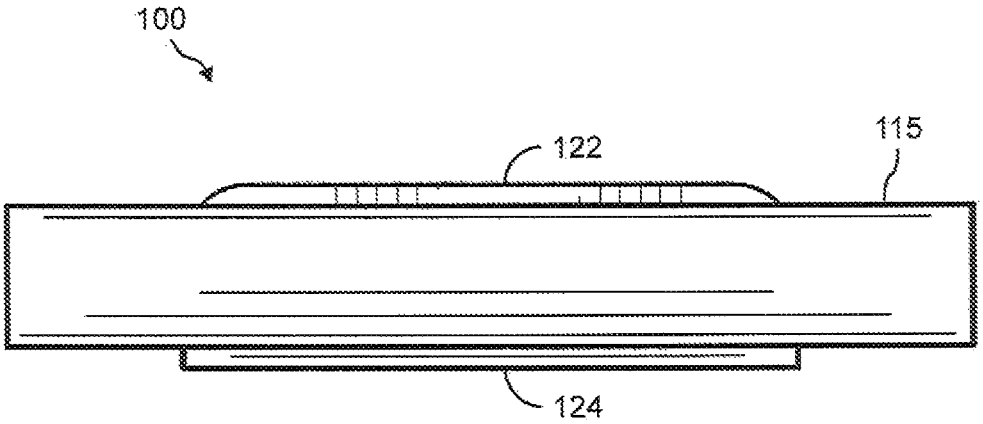
Figure 8:
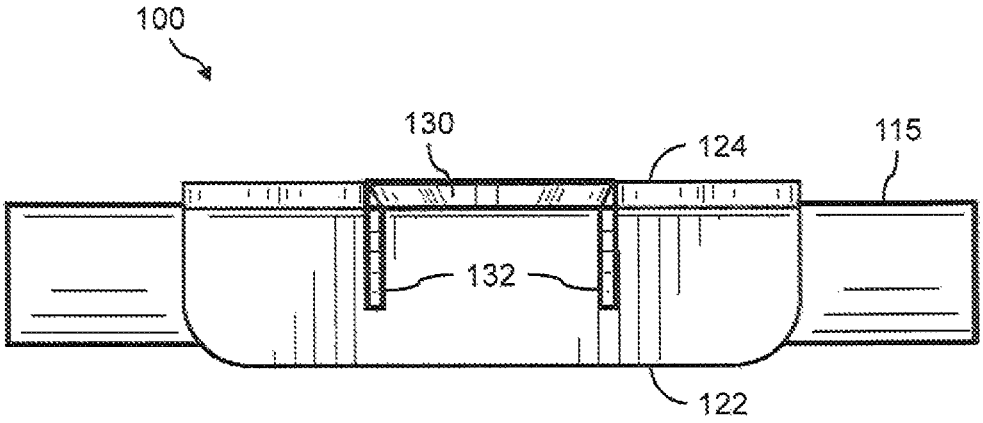
Figure 13:
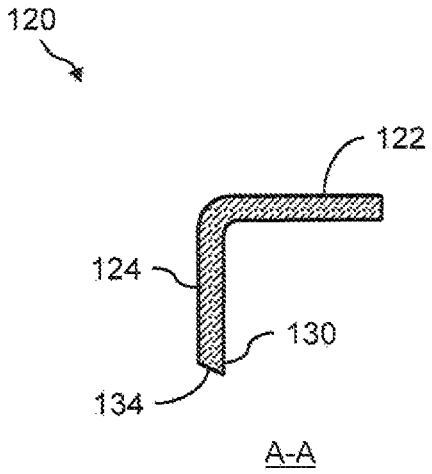
Figure 14:
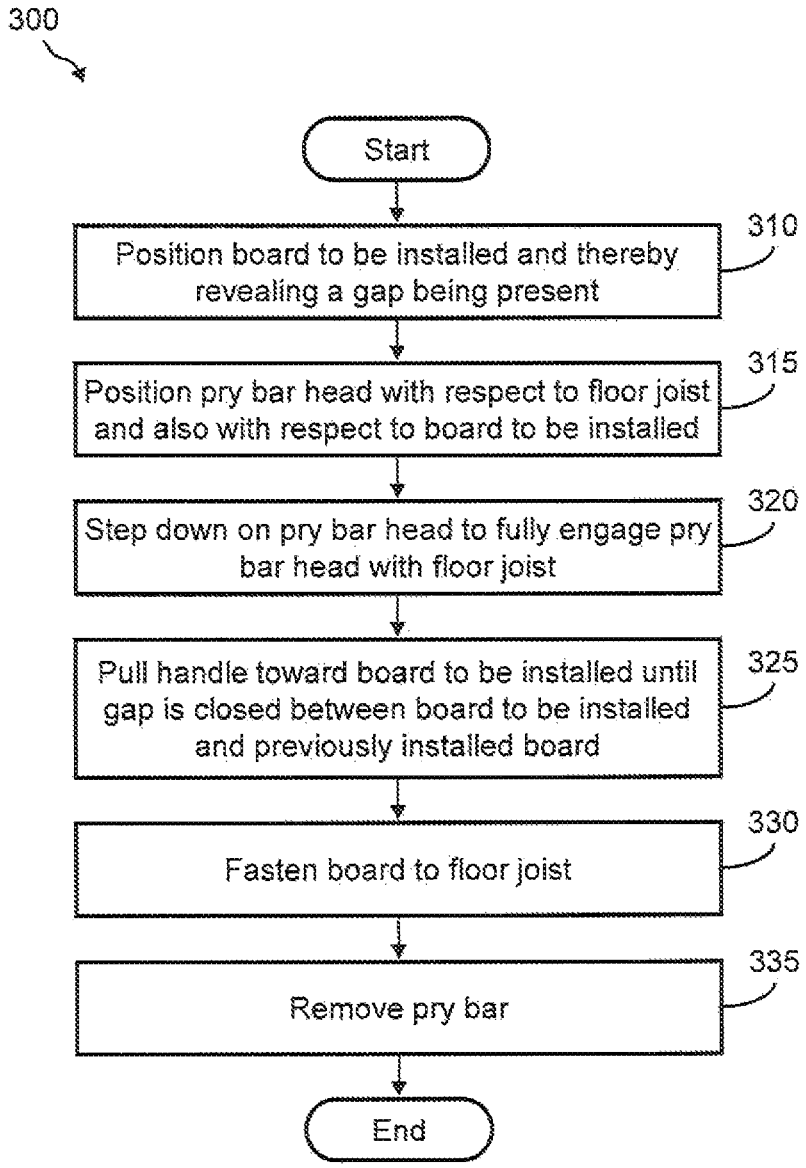
Figure 15:
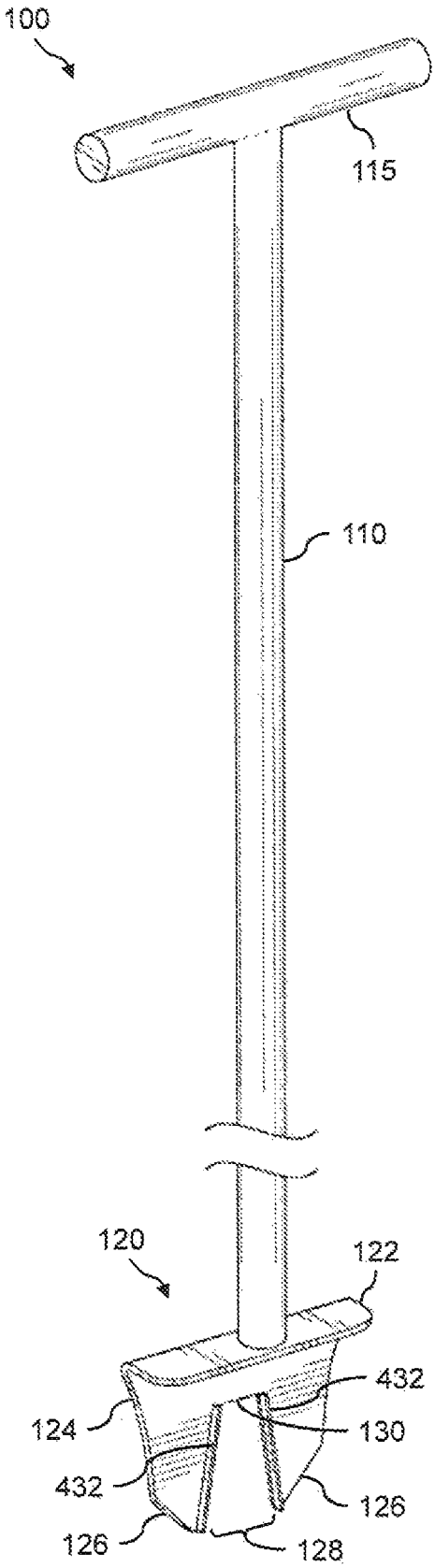
Figure 16:
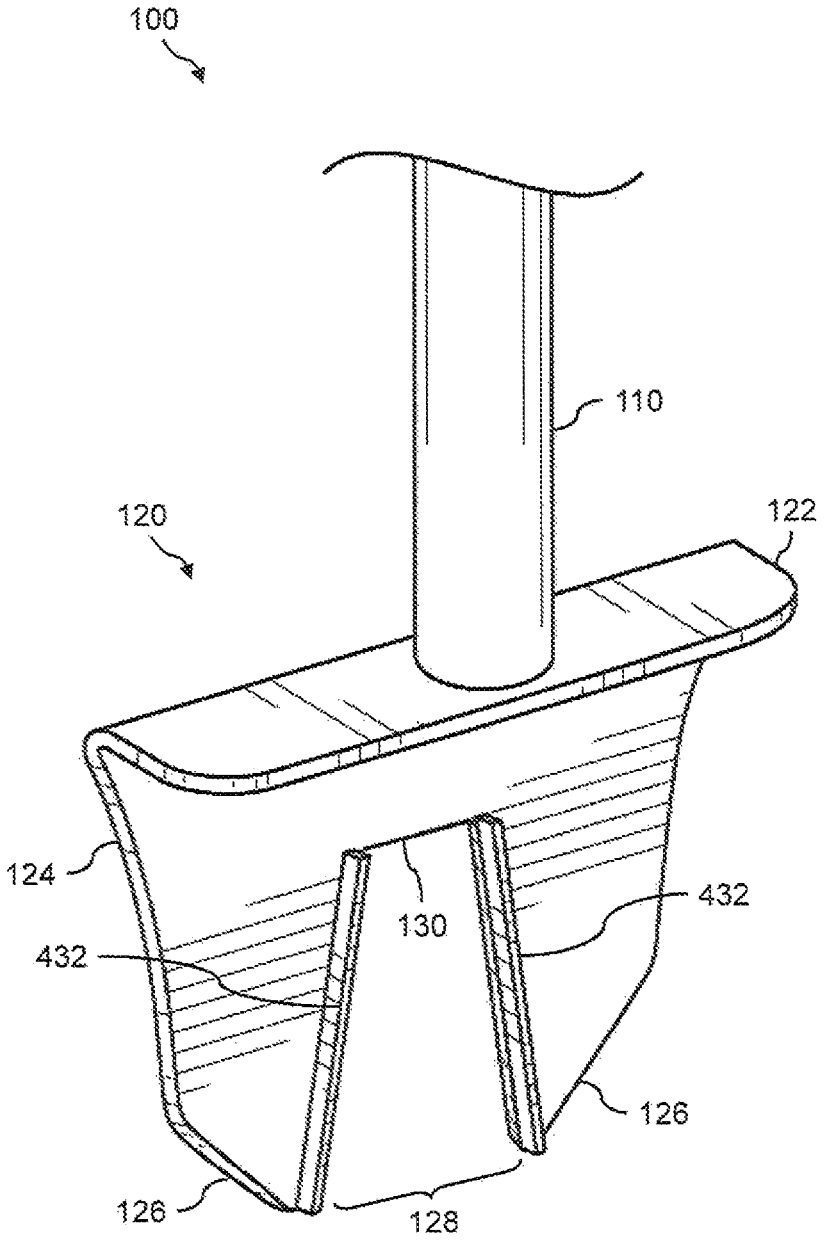
Figure 17:
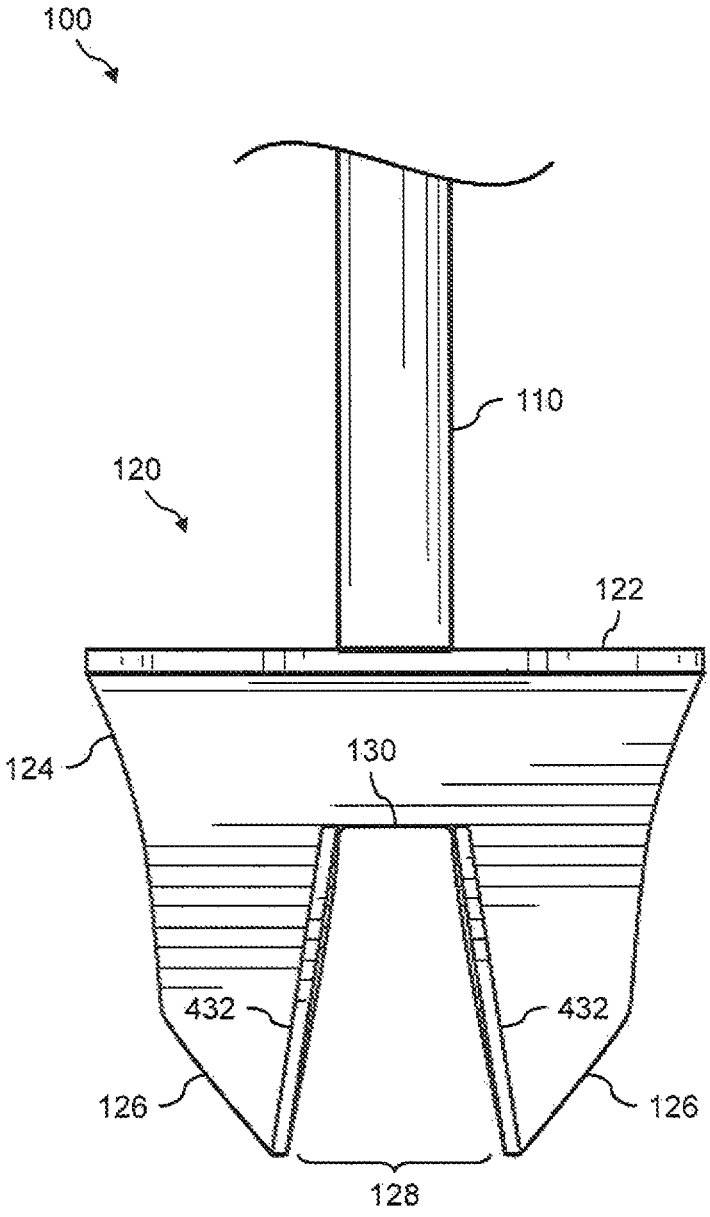
Figure 18:
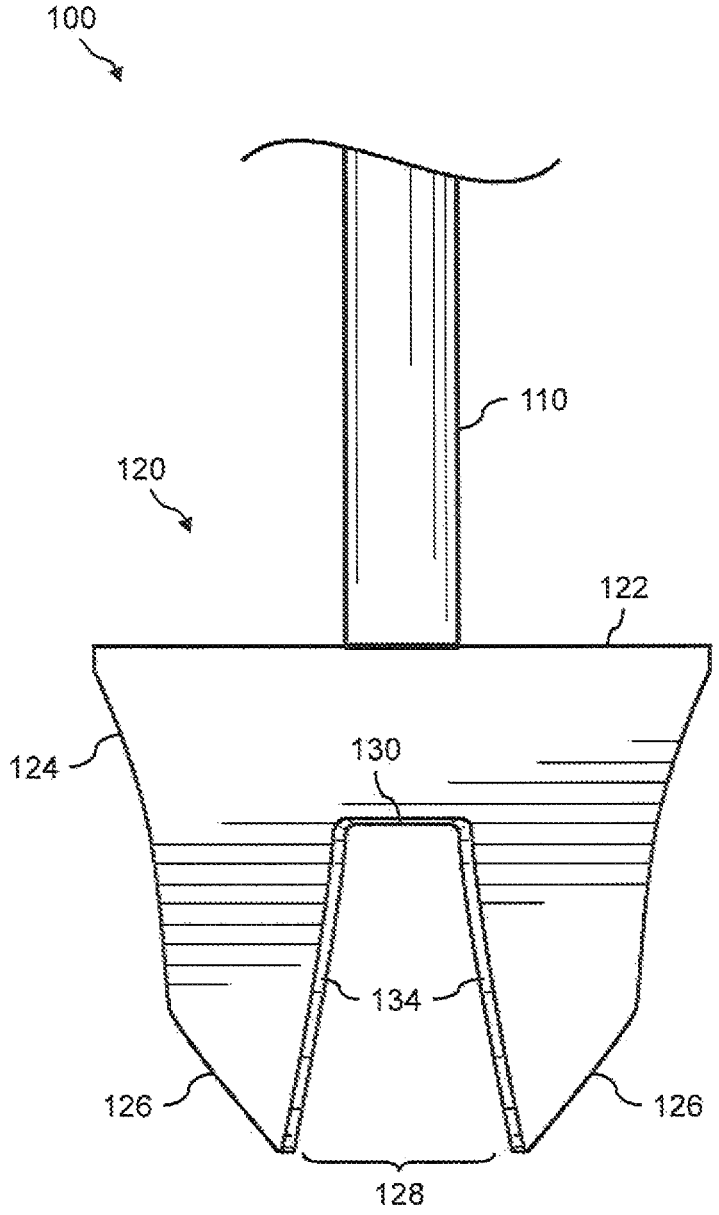
Figure 19:
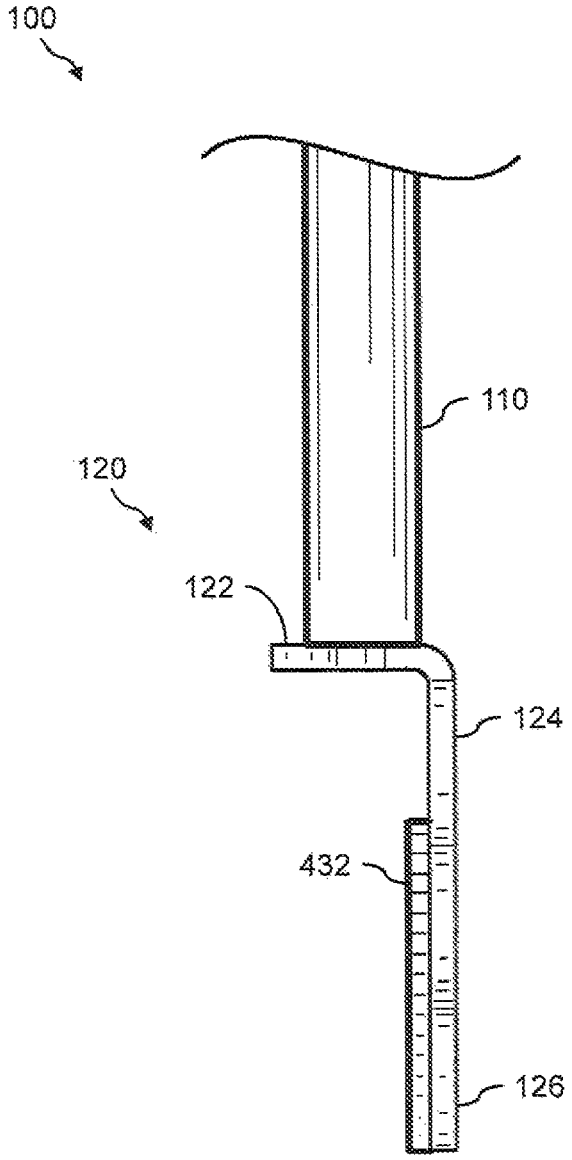
Figure 20:
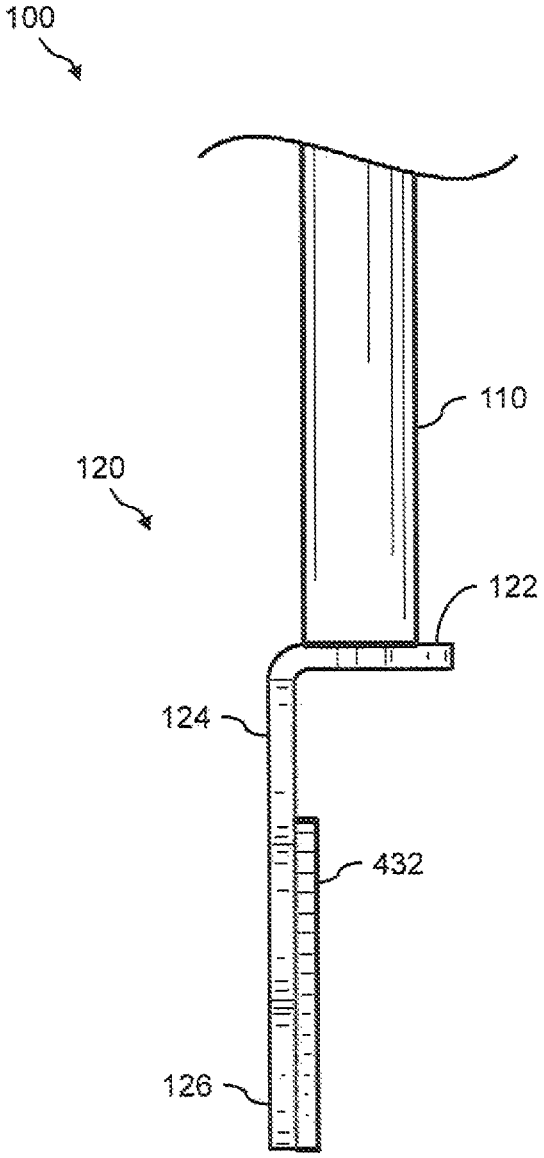
Figure 21:
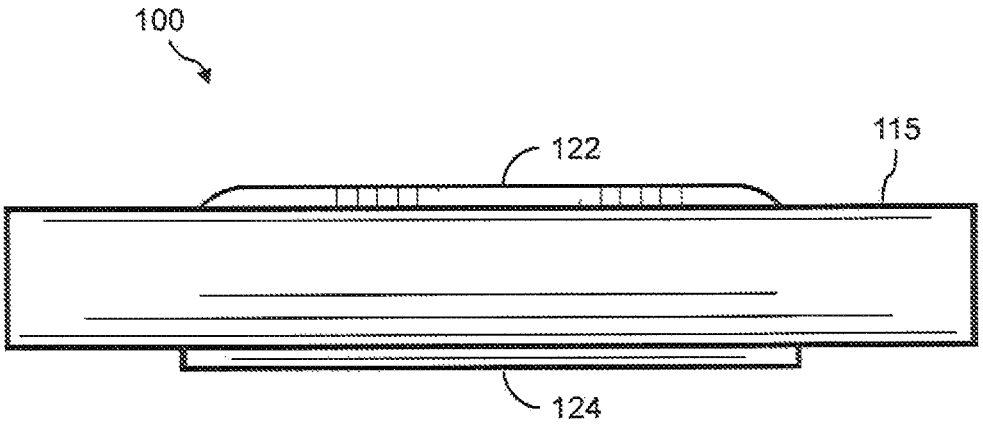
Figure 22:
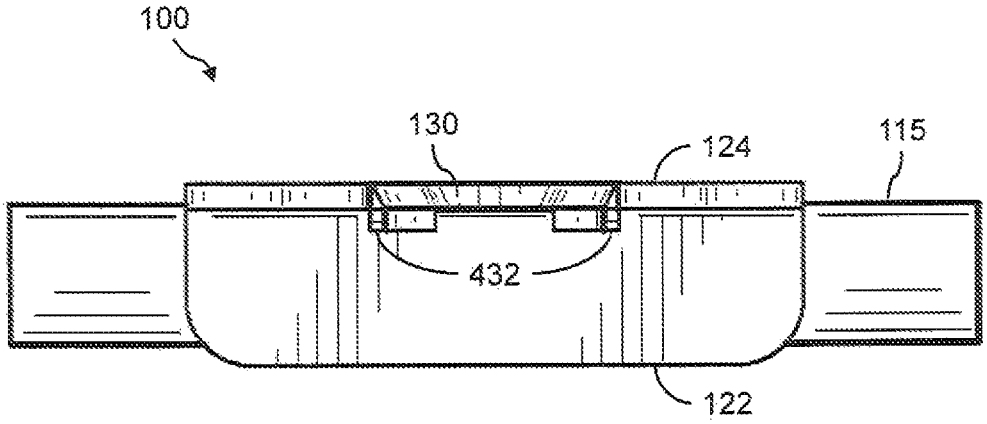
Figure 23:
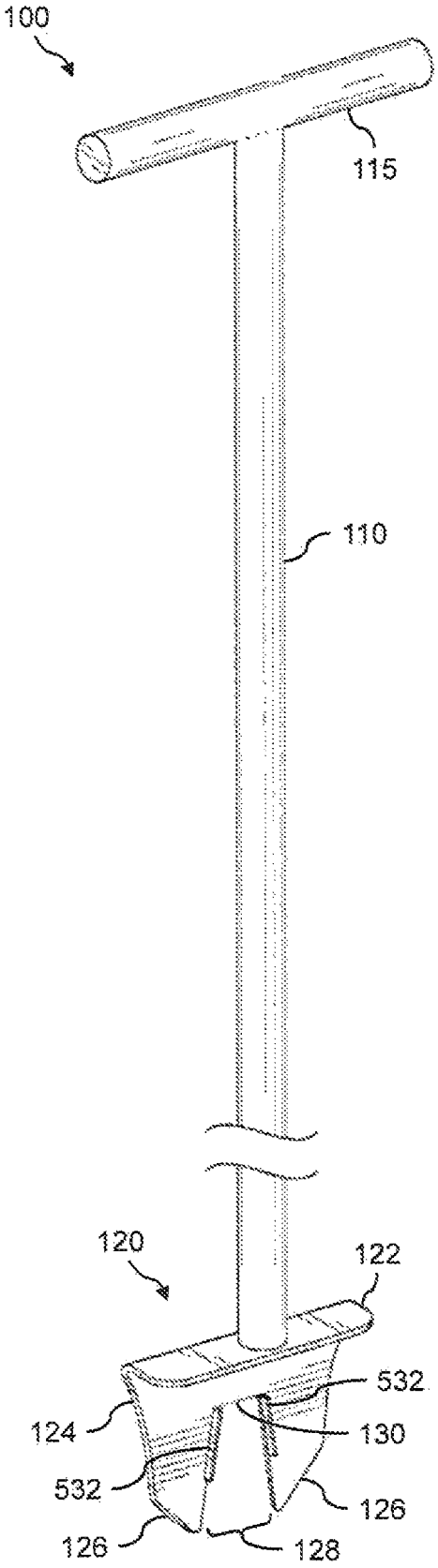
Figure 24:
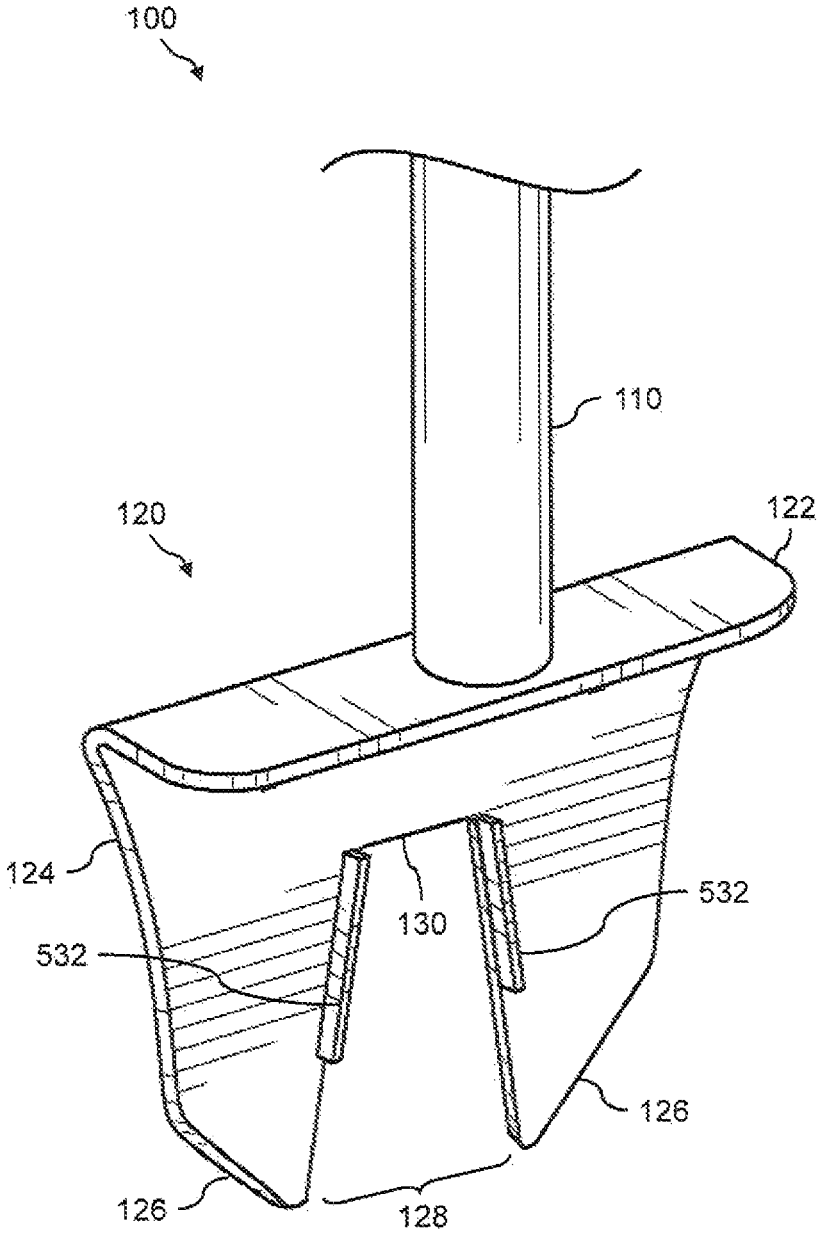
Figure 25:
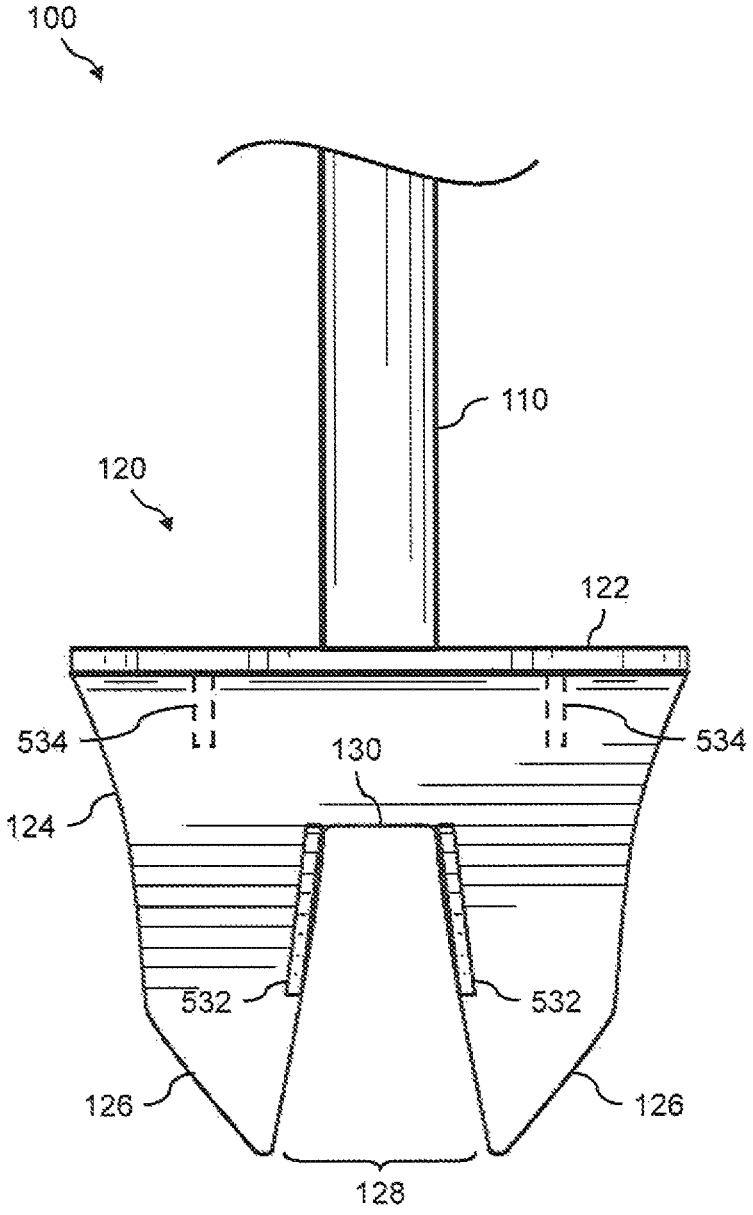
Figure 26:
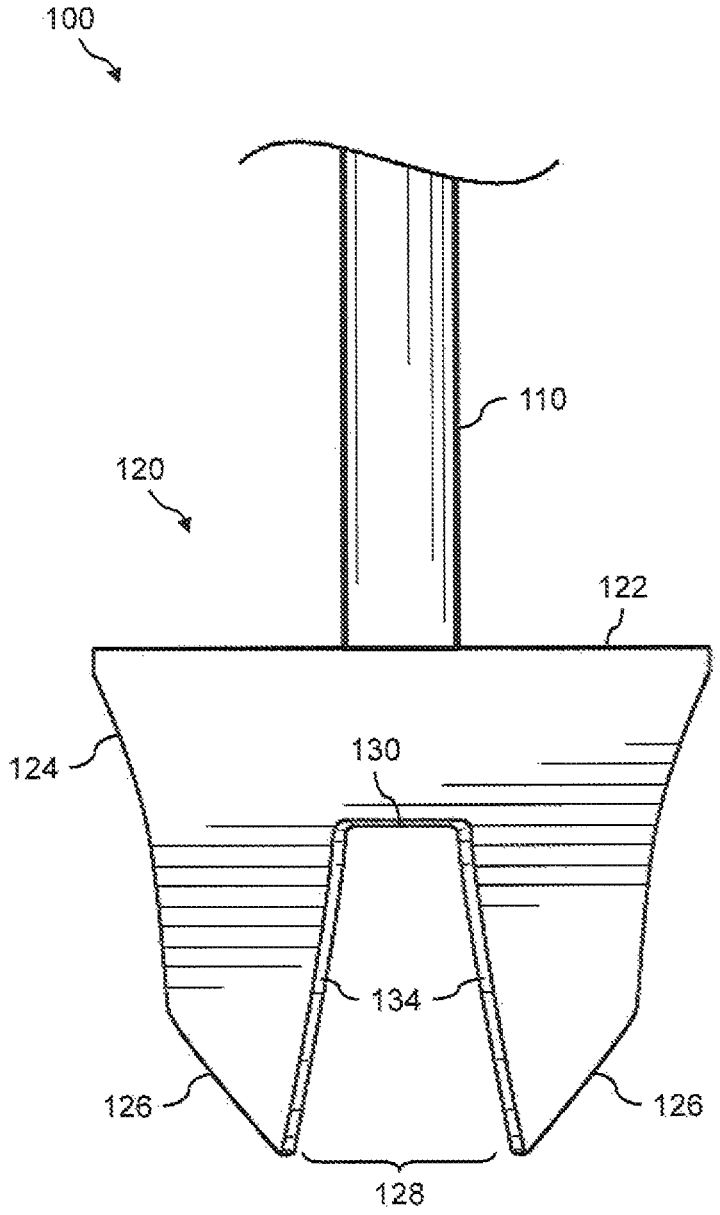
Figure 27:
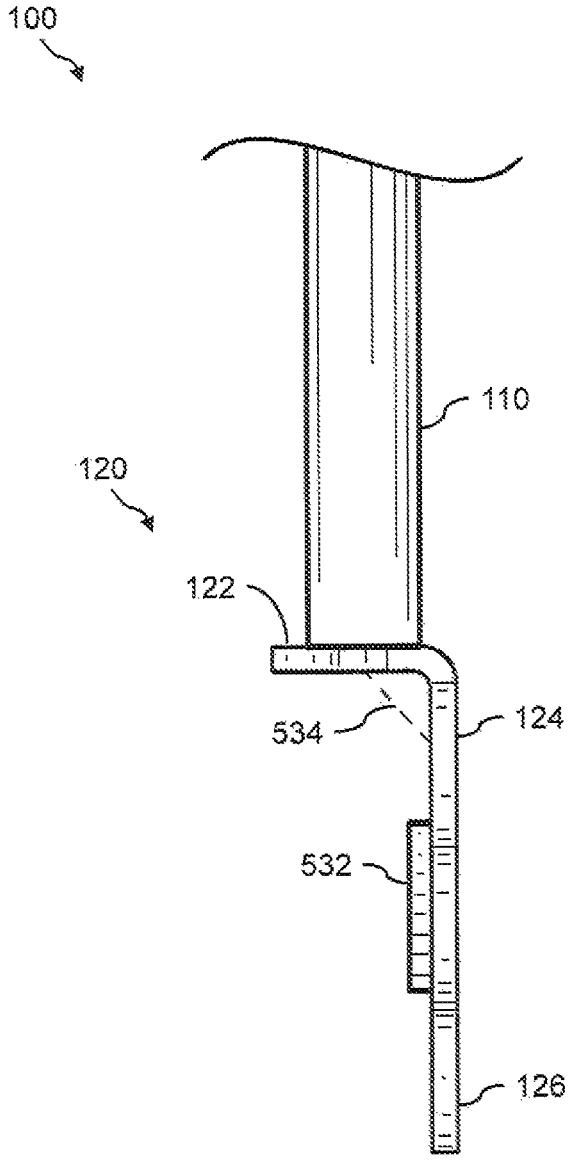
Figure 28:
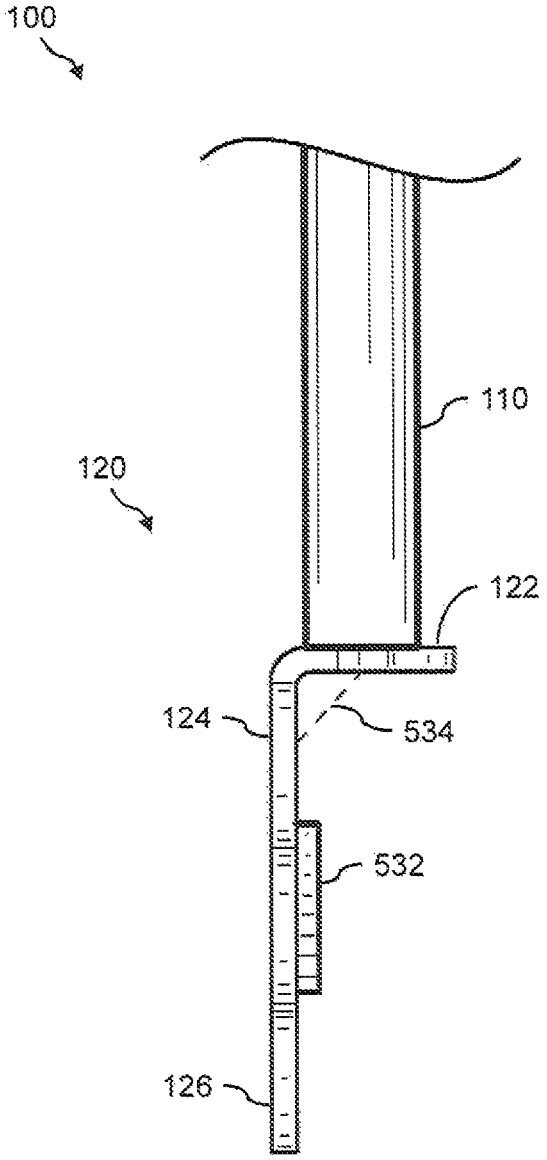
Figure 29:
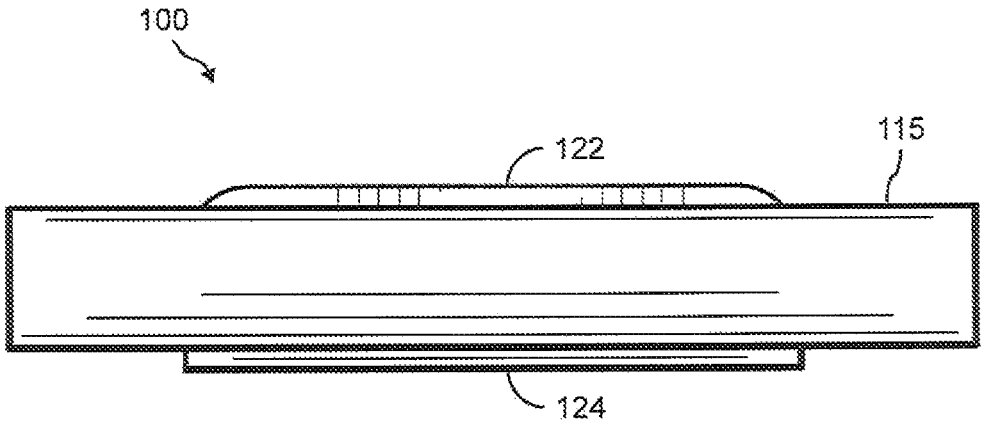
Figure 30:
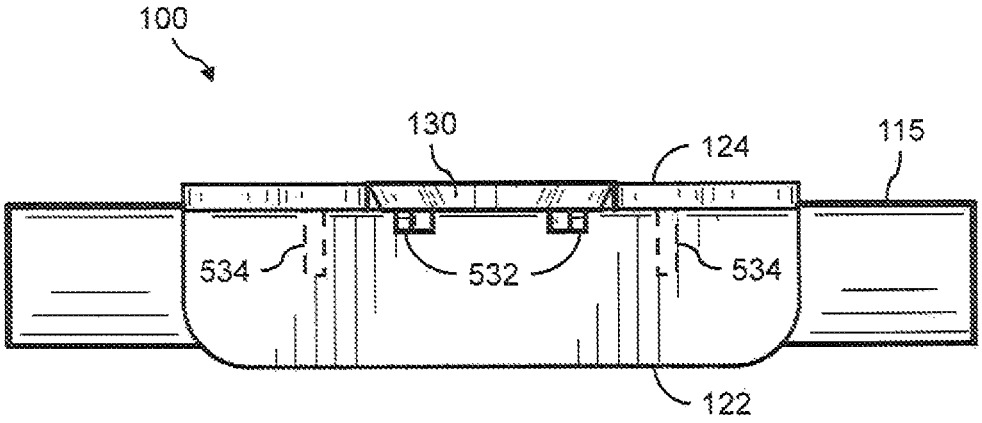

Having thus described the presently disclosed subject matter in general terms, reference will now be made to the accompanying Drawings, which are not necessarily drawn to scale, and wherein:

FIG. 1 illustrates a perspective view of an example of the presently disclosed pry bar for construction applications;

FIG. 2, FIG. 3, FIG. 4, FIG. 5, and FIG. 6 illustrate a perspective view, a back view, a front view, a first side view, and a second side view, respectively, of a pry bar head of the pry bar shown in FIG. 1;

FIG. 7 and FIG. 8 illustrate a top end view and a bottom end view, respectively, of the pry bar shown in FIG. 1;

FIG. 9, FIG. 10, FIG. 11, and FIG. 12 illustrate various views of the presently disclosed pry bar when in use;

FIG. 13 illustrates a cross-sectional view of the pivot edge portion of the pry bar head of the pry bar shown in FIG. 1;

FIG. 14 illustrates a flow diagram of an example of a method of using the presently disclosed pry bar for construction applications;

FIG. 15 illustrates a perspective view of another example of the presently disclosed pry bar for construction applications;

FIG. 16, FIG. 17, FIG. 18, FIG. 19, and FIG. 20 illustrate a perspective view, a back view, a front view, a first side view, and a second side view, respectively, of the pry bar head of the pry bar shown in FIG. 15;

FIG. 21 and FIG. 22 illustrate a top end view and a bottom end view, respectively, of the pry bar shown in FIG. 15;

FIG. 23 illustrates a perspective view of yet another example of the presently disclosed pry bar for construction applications;

FIG. 24, FIG. 25, FIG. 26, FIG. 27, and FIG. 28 illustrate a perspective view, a back view, a front view, a first side view, and a second side view, respectively, of the pry bar head of the pry bar shown in FIG. 23; and FIG. 29 and FIG. 30 illustrate a top end view and a bottom end view, respectively, of the pry bar shown in FIG. 23.

DETAILED DESCRIPTION

The presently disclosed subject matter will now be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a pry bar for construction applications and methods of using the same. Namely, a pry bar is provided for aiding in construction projects, such as, but not limited to, the construction of deck floors, porch floors, roof decks, and the like.

In one embodiment, the presently disclosed pry bar includes a main pry bar member, a handle at the top of the pry bar member, and a pry bar head at the bottom of the pry bar member. The pry bar head is designed to engage, for example, a floor joist in a pivoting fashion while at the same time apply pressure against the side of a floor board to be installed on the floor joist. Namely, the pry bar head includes a top plate, a faceplate that includes two prongs and a tapered slot between the two prongs for fitting around the floor joist. The face plate may also include a pivot edge at the top of the slot to engage with the floor joist, and optionally, various support members for stiffening the top plate and/or the faceplate.

The presently disclosed pry bar provides a mechanism for facilitating prying, pulling, forcing, or otherwise holding a bowed or warped piece of lumber or other construction building material (e.g., composite wood or composite decking material) in place while fastening the piece in place (e.g., using nails or screws). Further, the presently disclosed pry bar provides a construction aid for simply holding a construction member in place.

Further, methods of using the presently disclosed pry bar are provided. Namely, in one example, one worker both operates the presently disclosed pry bar and fastens the construction member in place. In another example, a first worker operates the presently disclosed pry bar while at least a second worker fastens the construction member in place.

Referring now to FIG. 1 through FIG. 8 are various views of an example of the presently disclosed pry bar 100 for construction applications. Namely, FIG. 1 shows a perspective view of pry bar 100. Further, FIG. 2, FIG. 3, FIG. 4, FIG. 5, and FIG. 6 show a perspective view, a back view, a front view, a first side view, and a second side view, respectively, of a pry bar head 120 of pry bar 100. Additionally, FIG. 7 and FIG. 8 show a top end view and a bottom end view, respectively, of pry bar 100 shown in FIG. 1.

Figure 4:
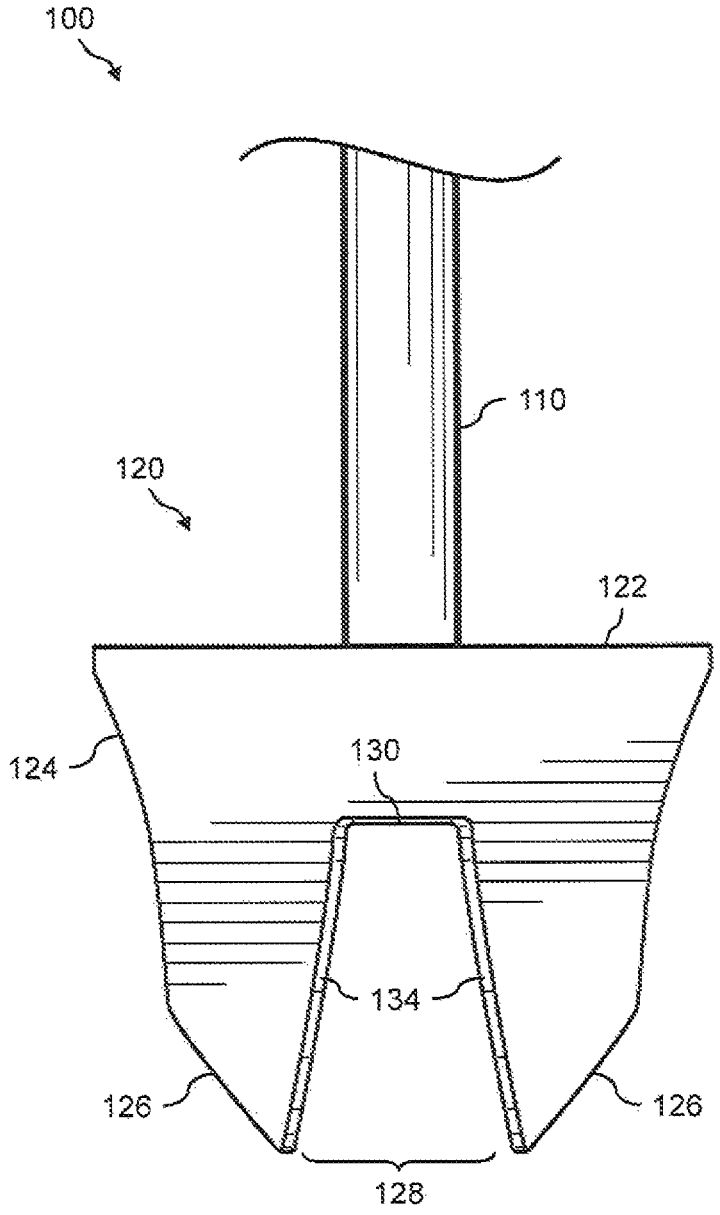
Figure 5:
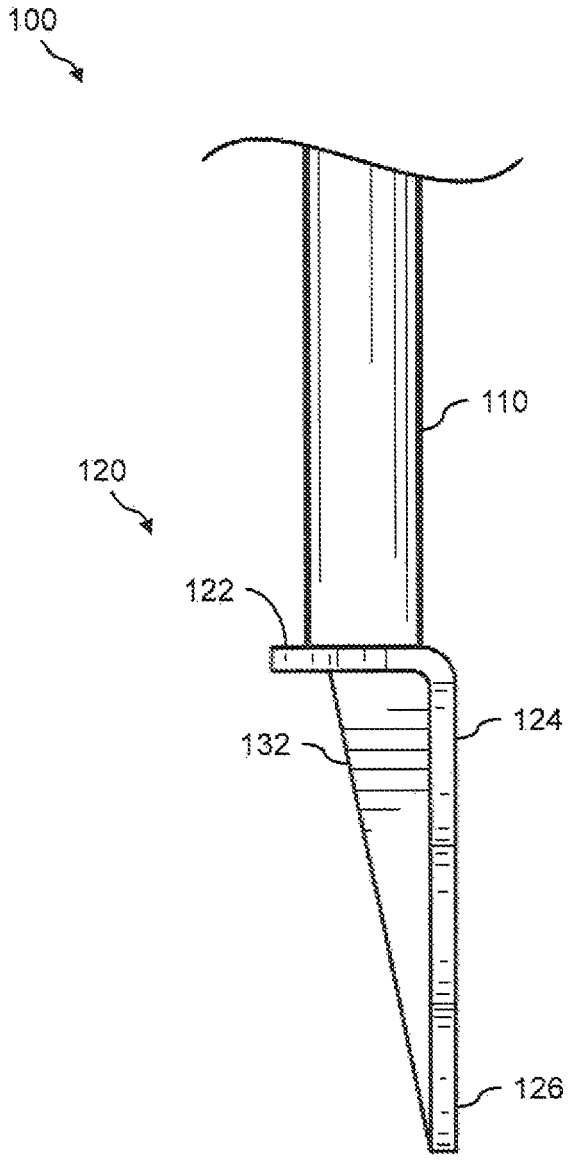
Figure 6:
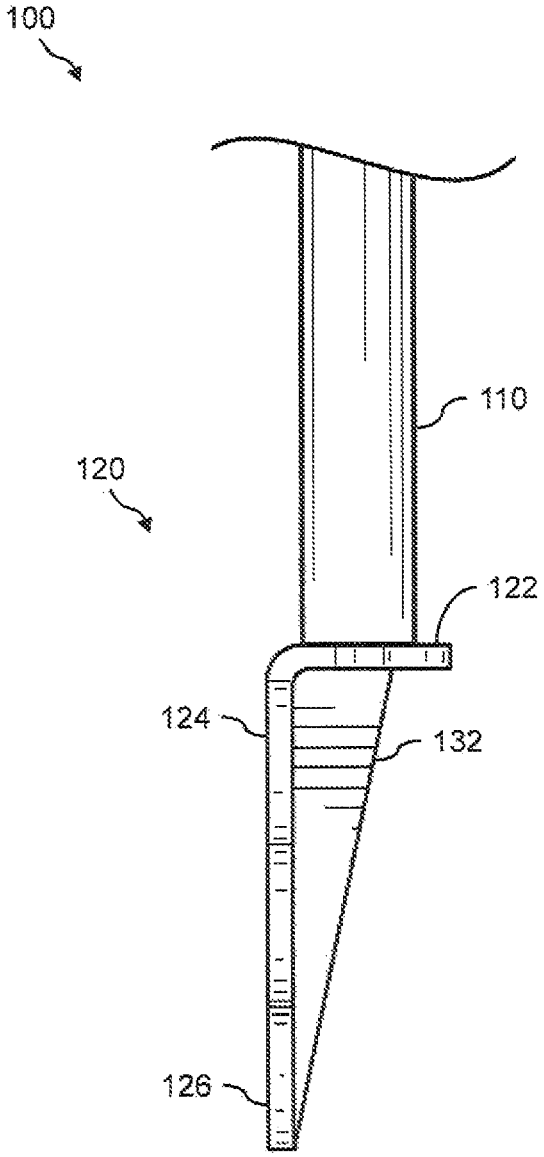

Pry bar 100 includes a main pry bar member 110, a handle (such as a straight handle, a handle or a D-grip, and shown as a handle) 115 at the top of pry bar member 110, and pry bar head 120 at the bottom of pry bar member 110. Pry bar head 120 is designed to engage, for example, a floor joist in a pivoting fashion while at the same time apply pressure against the side of a floor board to be installed on the floor joist. For example, pry bar head 120 of pry bar 100 includes a top plate 122 and a faceplate 124. Namely, one edge of top plate 122 is arranged at about a 90 degree angle with respect to the top edge of faceplate 124. Further, faceplate 124 includes two prongs 126 that extend away from top plate 122 and each generally taper to a point. A tapered slot 128 is provided between the two prongs 126 for fitting around, for example, a floor joist (see FIG. 9, FIG. 10, FIG. 11, FIG. 12). Additionally, a pivot edge 130 is provided at the top of tapered slot 128 to engage with, for example, the floor joist. Pry bar head 120 further includes various support members 132 for stiffening/strengthening top plate 122 and/or faceplate 124. In this example, support members 132 are essentially support brackets between top plate 122 and faceplate 124. Further, a bevel 134 is provided along the edges of tapered slot 128 as shown in FIG. 4, wherein bevel 134 provides a sharpened edge along tapered slot 128.

Further, in the presently disclosed pry bar 100 shown in FIG. 1 through FIG. 8, the terms "top," "bottom," "upper," "lower," "over," "under," "in," and "on" are used throughout the description with reference to the relative positions of components of pry bar 100. It will be appreciated that pry bar 100 is functional regardless of its orientation in space.

Pry bar member 110, handle 115, and pry bar head 120 of pry bar 100 are formed of any rigid and lightweight material as long as the material is strong enough for construction applications. Pry bar member 110, handle 115, and pry bar head 120 of pry bar 100 can be formed, for example, of metal, such as aluminum or steel. Further, pry bar member 110 and/or handle 115 can be formed of wood or composite wood. In one example, pry bar member 110, handle 115, and pry bar head 120 are formed as one fully integrated piece. In another example, pry bar member 110 and handle 115 are formed as one integrated piece and pry bar head 120 is formed separately, wherein the end of pry bar member 110 is attached substantially orthogonal to top plate 122 of pry bar head 120. In yet another example, pry bar member 110, handle 115, and pry bar head 120 are formed separately and then attached together. In this example, pry bar member 110 and/or handle 115 may be formed of metal or wood. In another example, handle 115 can be omitted entirely from pry bar 100. In another example, pry bar 100 can include any shaped handle. Further, pry bar member 110 and/or handle 115 of pry bar 100 can have any cross-sectional shape, such as circular, square, rectangular, hexagonal, octagonal, and the like.

Figure 2:
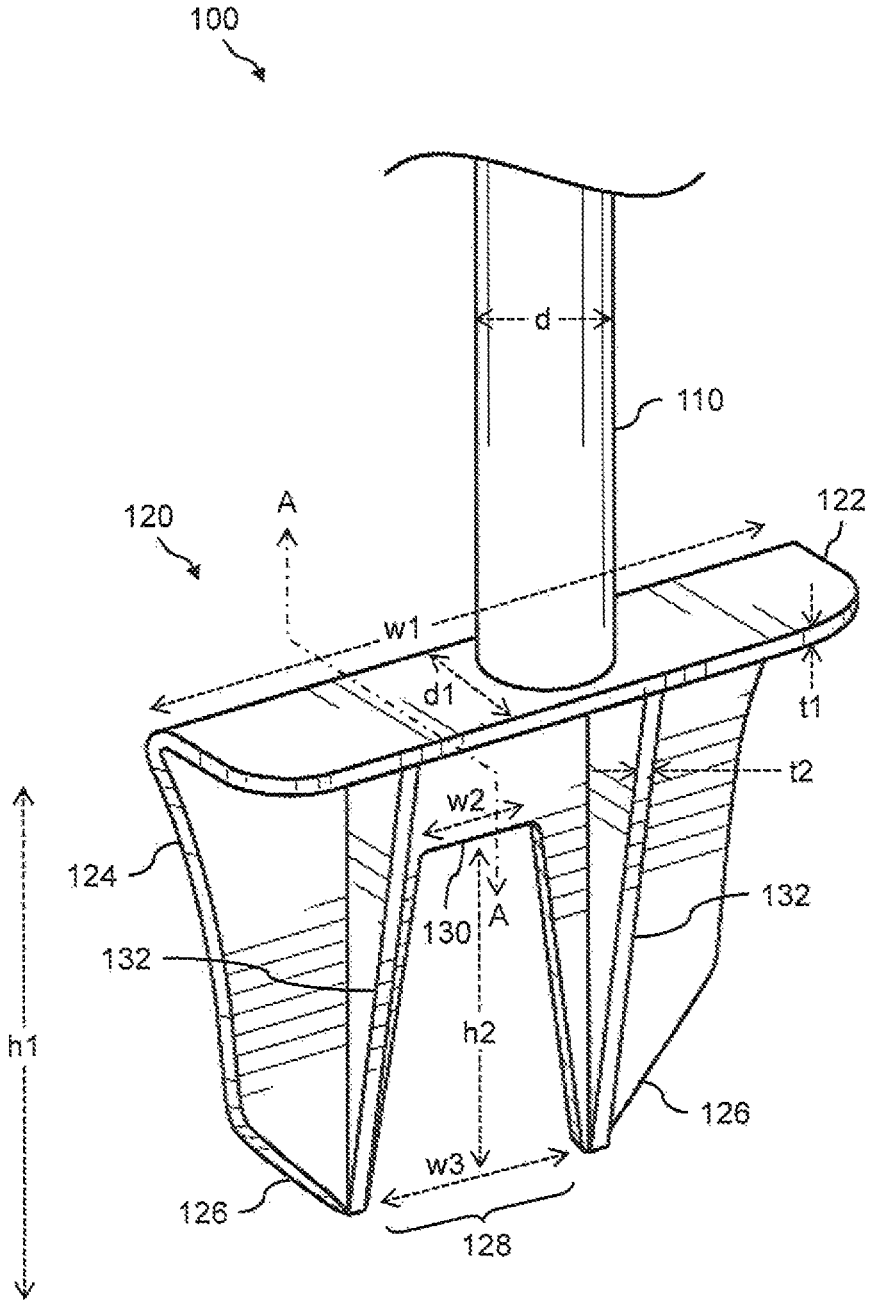
Figure 3:
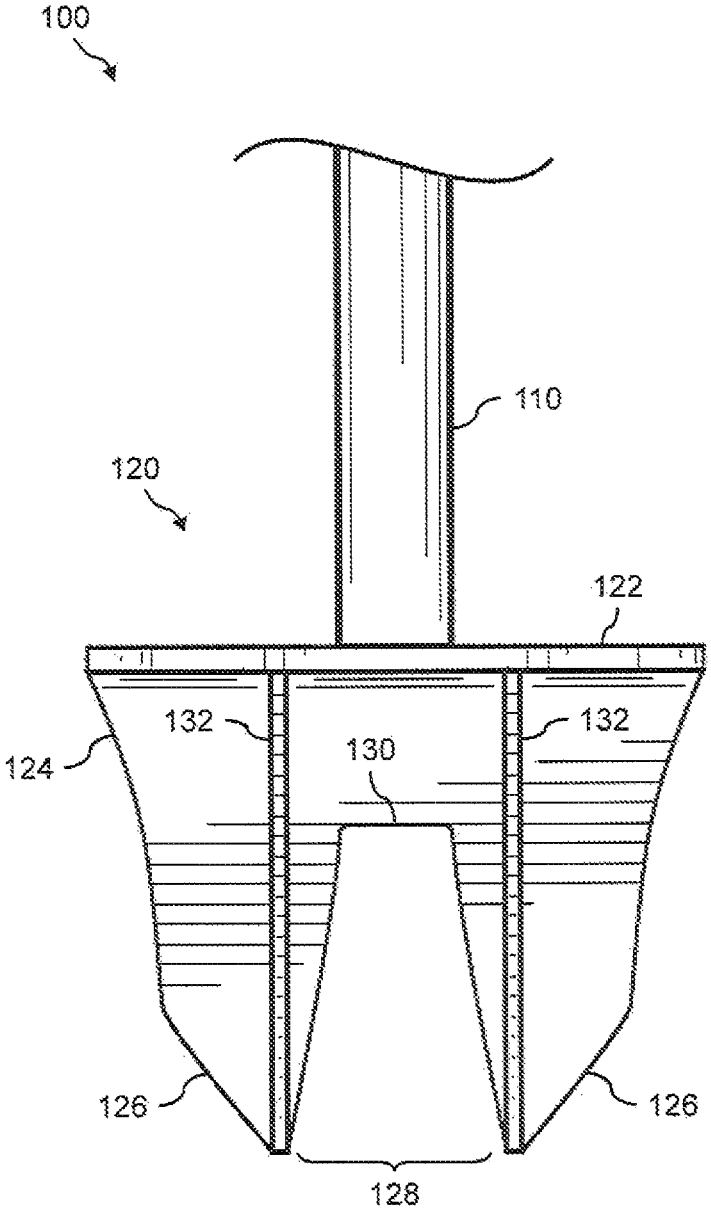

Referring now to FIG. 1 and FIG. 2, pry bar 100 has an overall length L1, pry bar member 110 has a length L2, handle 115 has a length L3, and both pry bar member 110 and handle 115 have a diameter d. The overall length L1 of pry bar 100 can be up to 50 inches in one example, from about 24 inches to about 38 inches in another one example, or is about 37 inches in another example. The length L2 of pry bar member 110 can be up to 45 inches in one example, from about 22 inches to about 32 inches in another example, or is about 31 inches in another example. The length L3 of handle 115 can be from about 5 inches to about 11 inches in one example, or is about 10 inches in another example. Further, the diameter d of both pry bar member 110 and handle 115 can be from about ½ inch to about 1¼ inches in one example, or is about 1 inch in another example. Additionally, the diameter d of pry bar member 110 and the diameter d of handle 115 can be the same or can be different.

Referring still to FIG. 1 and FIG. 2, pry bar head 120 has a height h1 and a width w1; top plate 122 of pry bar head 120 has a depth d1; top plate 122 and faceplate 124 of pry bar head 120 have a thickness t1; support members 132 of pry bar head 120 have a thickness t2; tapered slot 128 in faceplate 124 has a height h2; the top of tapered slot 128, which is pivot edge 130, has a width w2; and the bottom of tapered slot 128 has a width w3. The height h1 of pry bar head 120 can be from about 4 inches to about 7 inches in one example, or is about 4½ inches in another example. The width w1 of pry bar head 120 can be from about 4 inches to about 7 inches in one example, or is about 5½ inches in another example. The depth d1 of top plate 122 can be from about 1 inches to about 2 inches in one example, or is about 1½ inches in another example. The thickness t1 of top plate 122 and faceplate 124 can be from about 3/16 inches to about ½ inch in one example, or is about ⅛ inches in another example. The thickness t2 of support members 132 can be from about 3/16 inches to about ⅛ inches in one example, or is about ⅛ inches in another example. The height h2 of tapered slot 128 in faceplate 124 can be from up to about 2 inches to about 4 inches in one example, or is about 2¾ inches in another example. The width w2 of tapered slot 128 in faceplate 124 can be from about inches to about 1½ inches in one example, or is about 1 inch in another example. The width w3 of tapered slot 128 in faceplate 124 can be from about 1½ inches to about 3 inches in one example, or is about 1¾ inches in another example.

Figure 9:
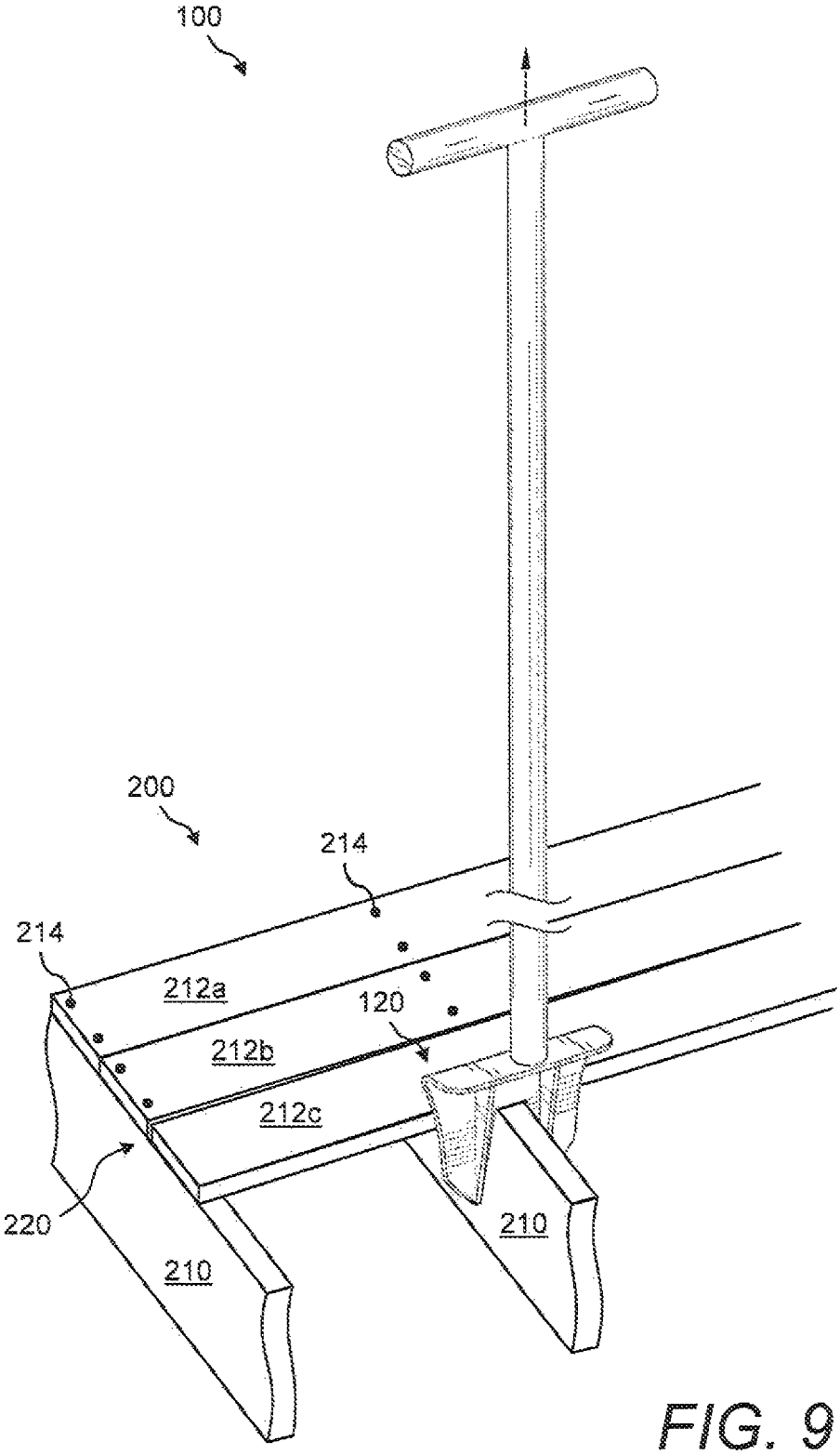

Referring now to FIG. 9, FIG. 10, FIG. 11, and FIG. 12 is various views of the presently disclosed pry bar 100 when in use. In this example, pry bar 100 can be used in the construction of a deck system 200. Deck system 200 includes an arrangement of floor joists 210 that support an arrangement of floorboards 212. Floorboards 212 are being fastened to floor joists 210 via fasteners 214. Fasteners 214 can be, for example, nails or screws. FIG. 9 shows floorboards 212*a* and 212*b* already fastened to floor joists 210, whereas floorboard 212*c* is being positioned for installation against floorboard 212*b*. In this example, floorboard 212*c* has a slight bow such that a gap 220 may be present between floorboard 212*c* and floorboard 212*b*.

Figure 10:
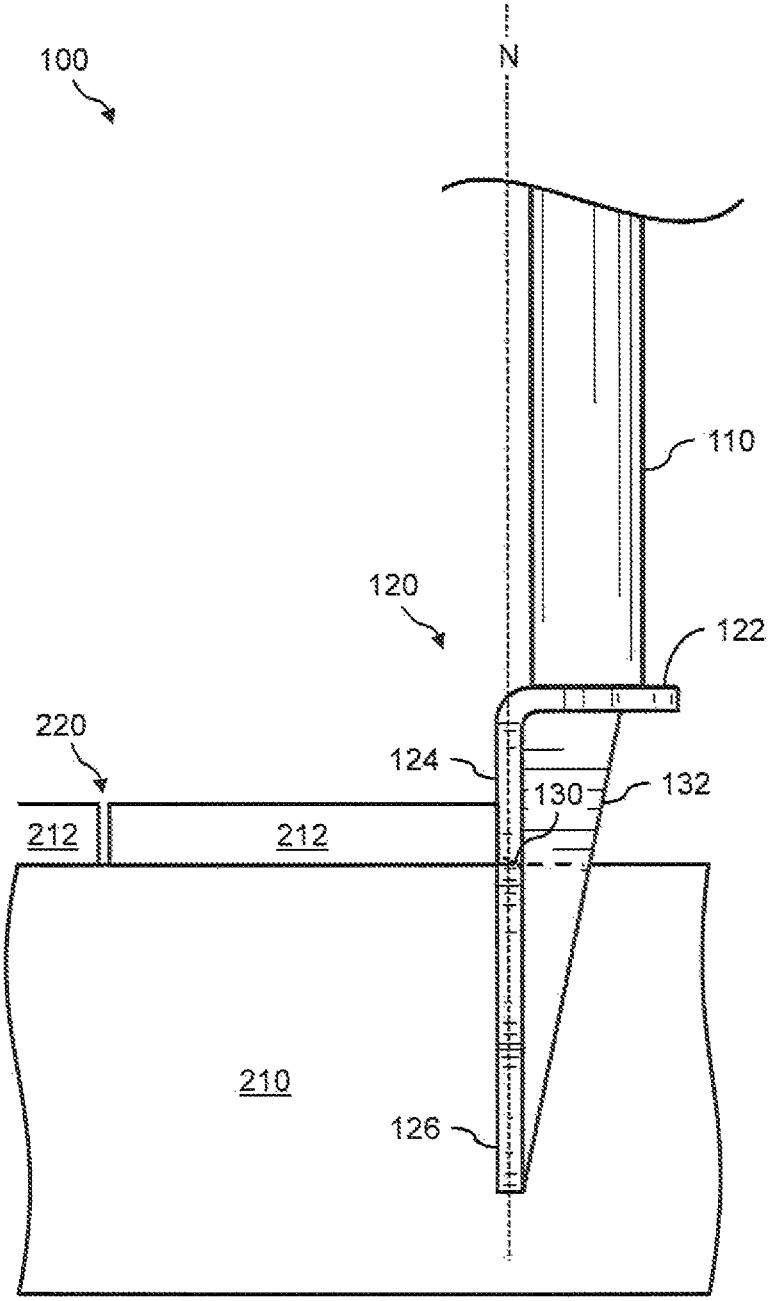

In this example, pry bar 100 can be used to easily pry, pull, or otherwise force the bowed floorboard 212*c* into place and then hold floorboard 212*c* in place while fastening. In a first step and referring now to FIG. 9, holding pry bar 100 substantially normal to the plane of floorboards 212, the user places faceplate 124 of pry bar head 120 against the side of floorboard 212*c* and with the two prongs 126 straddling one of the floor joists 210. Then the user steps down on top plate 122 of pry bar head 120 in order to engage pivot edge 130 with the top of the floor joist 210 as shown now in FIG. 10. Namely FIG. 10 shows pry bar 100 held at substantially normal N with faceplate 124 of pry bar head 120 against the side of floorboard 212*c*, pivot edge 130 engaged with the top of the floor joist 210, and gap 220 being present between floorboards 212*b* and 212*c*.

Figure 11:
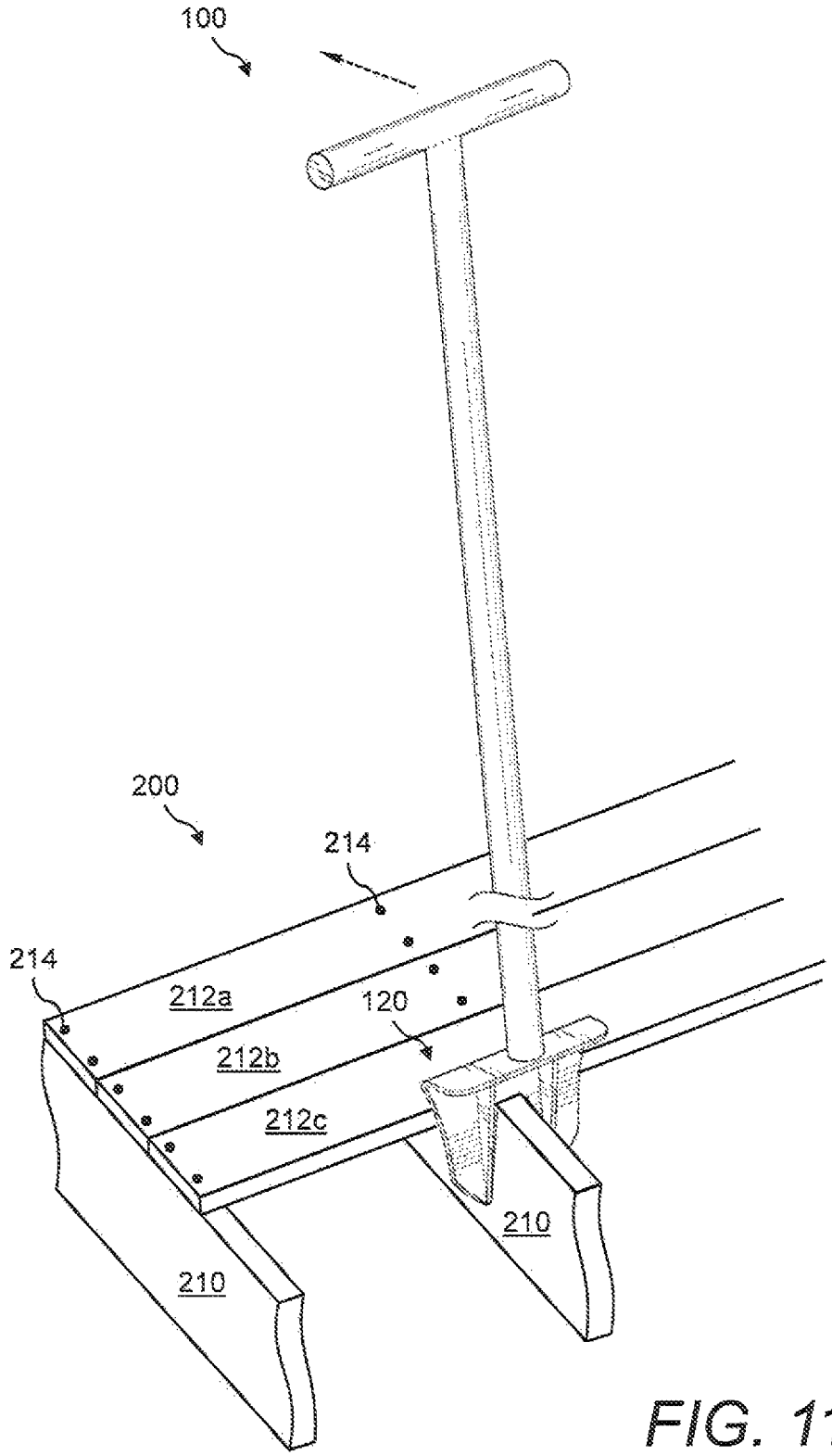
Figure 12:
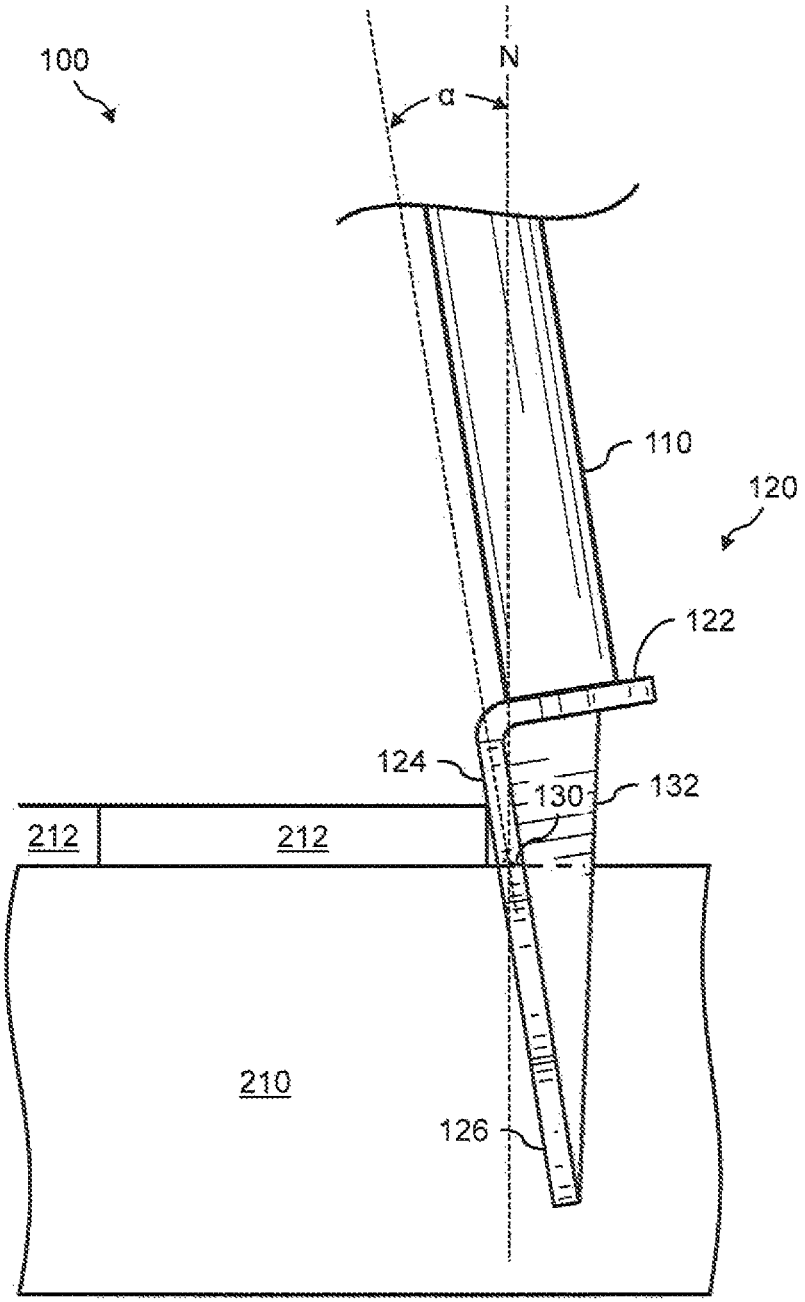

Next and referring now to FIG. 11, the user pulls handle 115 of pry bar 100 slightly toward floorboard 212*c*. In so doing, faceplate 124 of pry bar head 120 pries against the side of floorboard 212*c* as shown now in FIG. 12 and gap 220 is closed. More details of a method of using pry bar 100 are shown and described hereinbelow with reference to FIG. 14.

Referring now to FIG. 13 is a cross-sectional view of the pivot edge portion of pry bar head 120 of the pry bar 100 shown in FIG. 1. Namely, FIG. 13 is a cross-sectional view taken along line A-A of FIG. 2 and showing more details of pivot edge 130 at the top of tapered slot 128. In particular, bevel 134 provides a sharpened pivot edge 130 at the top of tapered slot 128. This sharpened pivot edge 130 can be engaged with a wood member and becomes the pivot point when operating pry bar 100.

Referring now to FIG. 14 is a flow diagram of an example of a method 300 of using the presently disclosed pry bar 100 for construction applications. Method 300 may include, but is not limited to, the following steps.

At a step 310, the user positions the board for installation and thereby revealing a gap due to, for example, a slight bow or warp in the board to be installed. For example and referring now to FIG. 9 and FIG. 10, floorboard 212*c* is positioned for installation against floorboard 212*b*. In this example, floorboard 212*c* may have a slight bow or warp that results in gap 220 being present between floorboard 212*c* and floorboard 212*b*.

At a step 315, the user positions pry bar head 120 with respect to the floor joist and also with respect to board to be installed. For example and referring still to FIG. 9 and FIG. 10, holding pry bar 100 substantially normal to the plane of floorboards 212, the user places faceplate 124 of pry bar head 120 against the side of floorboard 212*c* and with the two prongs 126 straddling one of the floor joists 210; namely, with the tapered slot 128 fitted atop one of the floor joists 210.

At a step 320, the user steps down on to fully engage pry bar head 120 with the floor joist. For example and referring still to FIG. 9 and FIG. 10, the user steps down on top plate 122 of pry bar head 120 in order to engage pivot edge 130 with the top of the floor joist 210 as shown now in FIG. 10.

At a step 325, the user pulls the handle of pry bar head 120 toward the board to be installed until the gap is closed between the board to be installed and any previously installed board. For example and referring now to FIG. 11 and FIG. 12, the user pulls handle 115 of pry bar 100 slightly toward floorboard 212*c* until gap 220 is closed between floorboard 212*c* and the previously installed floorboard 212*b*.

At a step 330, the user fastens the board to the floor joist. For example and referring still to FIG. 1 and FIG. 12, the user fastens floorboard 212*c* to the floor joist 210.

At a step 335, the user removes pry bar 100. For example and referring still to FIG. 9 through FIG. 12, the user disengages pry bar head 120 from the floor joist 210 and removes pry bar 100.

Further, in one example of method 300, one worker (or user) both operates the presently disclosed pry bar 100 and fastens the construction member (e.g., floorboard 212*c*) in place. In another example of method 300, a first worker (or user) operates the presently disclosed pry bar 100 while a second worker fastens the construction member (e.g., floorboard 212*c*) in place.

Referring now to FIG. 15 through FIG. 22 is various views of another example of the presently disclosed pry bar 100 for construction applications. Namely, FIG. 15 shows a perspective view of pry bar 100. Further, FIG. 16, FIG. 17, FIG. 18, FIG. 19, and FIG. 20 show a perspective view, a back view, a front view, a first side view, and a second side view, respectively, of pry bar head 120 of the pry bar 100 shown in FIG. 15. Additionally, FIG. 21 and FIG. 22 show a top end view and a bottom end view, respectively, of the pry bar 100 shown in FIG. 15.

The example of pry bar 100 shown in FIG. 15 through FIG. 22 is substantially the same as pry bar 100 shown in FIG. 1 through FIG. 8 except that support members 132 have been replaced with support members 432. In this example, support members 432 are provided along the side edges of tapered slot 128. Namely, support members 432 are provided along substantially the full length of the side edges of tapered slot 128.

Referring now to FIG. 23 through FIG. 30 is various views of yet another example of the presently disclosed pry bar 100 for construction applications. Namely. FIG. 23 shows a perspective view of pry bar 100. Further, FIG. 24, FIG. 25, FIG. 26, FIG. 27, and FIG. 28 show a perspective view, a back view, a front view, a first side view, and a second side view, respectively, of pry bar head 120 of the pry bar 100 shown in FIG. 23. Additionally, FIG. 29 and FIG. 30 show a top end view and a bottom end view, respectively, of the pry bar 100 shown in FIG. 23.

The example of pry bar 100 shown in FIG. 23 through FIG. 30 is substantially the same as pry bar 100 shown in FIG. 15 through FIG. 22 except that support members 432 have been replaced with support members 532. In this example, support members 532 are provided along the side edges of tapered slot 128. Namely, support members 532 are provided along the upper portion only of the side edges of tapered slot 128. Optionally, pry bar 100 may also include support members 534 for stiffening top plate 122 and face plate 124. In this example, support members 534 are essentially small support brackets between top plate 122 and faceplate 124.

Embodiments of the presently disclosed pry bar 100 can include any combinations of support members 132 shown in FIG. 1 through FIG. 8, support members 432 shown in FIG. 15 through FIG. 22, and support members 532 and/or support members 534 shown in FIG. 23 through FIG. 30.

Referring now again to FIG. 1 through FIG. 30, the presently disclosed pry bar 100 and method 300 can be used for aiding in wood construction projects, such as, but not limited to, the construction of deck floors, porch floors, roof decks, and the like. Namely, the presently disclosed pry bar 100 and method 300 provide a mechanism for easily prying, pulling, forcing, or otherwise holding a bowed or warped piece of lumber in place while fastening the piece in place (e.g., using nails or screws). Further, the presently disclosed pry bar 100 and method 300 provide a construction aid for simply holding a construction member in place. It should be understood that construction materials, boards, lumber etc. encompass natural wood, engineered wood and composite materials such as plywood, densified wood, fiberboard, particle board, laminates, polymer-based products, etc.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments, ±100% in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A construction tool configured to hold a bowed or warped piece of lumber or other construction building material in place while fastening the piece in place, the construction tool comprising:

a bar;

a handle extending substantially perpendicular from an end of the bar;

a flat faceplate comprising two prongs and a tapered slot therebetewen, the two prongs tapering to a point where the tapered slot opens, the tapered slot comprises side edges that taper along an entire depth of the tapered slot and is configured to receive a joist, wherein the faceplate further comprises at least one support member extending substantially perpendicular to the faceplate and provided along the side edges of the tapered slot; and a top plate that is substantially perpendicular to the faceplate and extends from a top edge of the faceplate, wherein the bar extends from a central portion of the top plate.

2. The construction tool of claim 1, wherein the at least one support member is provided along an upper portion only of the side edges of the tapered slot.

3. The construction tool of claim 1, wherein the at least one support member is provided substantially along a full length of the side edges of the tapered slots.

4. The construction tool of claim 1, wherein the faceplate further comprises at least one additional support member, the at least one additional support member comprises a bracket.

5. The construction tool of claim 1, wherein the faceplate further comprises at least one additional support member, the at least one additional support member contacts the top plate and the faceplate.

6. The construction tool of claim 5, wherein the at least one additional support member comprises a bracket.

7. The construction tool of claim 1, wherein the bar and handle comprise one integrated apparatus.

8. The construction tool of claim 1, wherein the bar, handle and faceplate comprise one integrated apparatus.

9. The construction tool of claim 1, wherein at least one of the bar, handle and faceplate is interchangeable with an alternative bar, handle or faceplate, respectively.

10. A method of holding a piece of wood or composite construction material in place while fastening the piece, the method comprising:

providing the construction tool of claim 1;

using the construction tool of claim 1 to engage a floor joist in a pivoting fashion; and simultaneously applying pressure against a side of a floor board to be installed on the floor joist.

11. The method of claim 10, wherein the piece of wood or composite construction material is a bowed or warped piece of wood or composite construction material.

12. The method of claim 10 further comprising:

positioning a board to be installed thereby revealing a gap between the board and a previously installed board;

positioning the faceplate with respect to a floor joist and also with resect to the hoard to be installed;

applying pressure to the faceplate;

manipulating the handle until the gap is closed; and fastening the board in place.

13. The method of claim 10, wherein the piece of wood or composite construction material is natural wood.

14. The method of claim 10, wherein the piece of wood or composite construction material is a composite material.

15. The method of claim 10, wherein the composite material is plywood, densified wood, fiberboard, particle board, a laminate, a polymer-based product, or a combination thereof.

* * * * *